US011279447B2

(12) United States Patent
Lee

(10) Patent No.: US 11,279,447 B2
(45) Date of Patent: Mar. 22, 2022

(54) WATER SPORTS BOARD RACK

(71) Applicant: John Kenneth Lee, Porterville, CA (US)

(72) Inventor: John Kenneth Lee, Porterville, CA (US)

( * ) Notice: Subject to any disclaimer, the term of this patent is extended or adjusted under 35 U.S.C. 154(b) by 0 days.

(21) Appl. No.: 17/009,754

(22) Filed: Sep. 1, 2020

(65) Prior Publication Data

US 2021/0001962 A1 Jan. 7, 2021

Related U.S. Application Data

(63) Continuation of application No. 16/164,827, filed on Oct. 19, 2018, now Pat. No. 10,759,504.

(60) Provisional application No. 62/675,544, filed on May 23, 2018.

(51) Int. Cl.
*B63B 25/00* (2006.01)
*B63B 32/83* (2020.01)

(52) U.S. Cl.
CPC ..... *B63B 25/002* (2013.01); *B63B 32/83* (2020.02)

(58) Field of Classification Search
CPC ..... B63B 32/80; B63B 25/002; B63B 17/02; B63B 25/00; B63B 35/85; B63B 35/7946; B60R 9/12; E04H 15/06; Y10S 224/917
See application file for complete search history.

(56) References Cited

U.S. PATENT DOCUMENTS 4,056,220 A 11/1977 Trimble
4,527,827 A 7/1985 Maniscalco
4,630,990 A 12/1986 Whiting
4,729,535 A * 3/1988 Frazier ..... A47J 37/0786 126/24
4,863,082 A 9/1989 Evans
5,014,955 A 5/1991 Thompson
5,582,044 A * 12/1996 Bolich ..... B60R 9/08 224/315
5,673,889 A 10/1997 DeValcourt
5,788,133 A * 8/1998 Mareno ..... B63B 23/62 224/406

(Continued)

FOREIGN PATENT DOCUMENTS

WO 2006072055 7/2006
WO 2018004835 1/2018

*Primary Examiner* — Ko H Chan

(74) *Attorney, Agent, or Firm* — Sierra IP Law, PC; William K. Nelson

(57) ABSTRACT

The present invention provides a watersports board rack for attaching to a support member (e.g., hanging down from an overhead support tower) of a boat. The rack may have a low profile, superior padding and an increased contact area compared to current rack systems, as well as at least one strap for securing the board against the padding and a coupler for attaching to the overhead support member. The rack may thus be operable to securely hold up to two watersports boards (e.g., two wakesurf boards) without the usual wear and tear (e.g., dents and scrapes) that occurs from regular contact with the tines of current rack systems. The rack may thus increase the boat's capacity to securely store watersports boards while the boat is in motion, and due to the low profile, the rack will not substantially reduce headroom or require removal from a folding tower before folding the tower down for transporting and storing the boat.

20 Claims, 11 Drawing Sheets

(56) References Cited

U.S. PATENT DOCUMENTS 5,934,488 A * 8/1999 Grimshaw ..... A63C 11/028 211/70.5
6,196,397 B1 * 3/2001 Maher ..... A47B 81/00 211/70.5
6,257,261 B1 7/2001 Johnson
6,327,993 B1 12/2001 Richens
6,439,150 B1 8/2002 Murphy et al.
6,666,163 B2 12/2003 Pastor et al.
6,715,653 B2 4/2004 DeCosta
6,799,529 B1 10/2004 Willis
6,827,226 B2 * 12/2004 Coulson ..... A47B 45/00 211/70.5
6,863,016 B2 3/2005 Biemiller
6,935,517 B1 * 8/2005 Reed ..... A47B 81/00 211/70.5
7,418,918 B2 9/2008 Bierbower et al.
7,721,900 B2 * 5/2010 Waterman ..... A47F 7/0028 211/70.5
7,896,175 B1 * 3/2011 Corr ..... B63B 32/80 211/86.01
D640,707 S 6/2011 Veh
8,025,194 B2 9/2011 Jesewitz
8,123,051 B2 * 2/2012 Johnson ..... A47F 7/0021 211/87.01
8,281,732 B1 10/2012 Irvine
8,297,484 B2 10/2012 Jesewitz et al.
D674,804 S 1/2013 Cote
8,561,864 B2 10/2013 Gisin
8,567,651 B2 10/2013 Jesewitz
D696,671 S 12/2013 Carnevali
8,720,752 B2 5/2014 Huang et al.
8,807,505 B2 8/2014 Lotz
8,905,281 B2 12/2014 Jesewitz
9,114,855 B2 8/2015 Nemeth
9,139,259 B2 9/2015 Williams et al.
9,302,742 B2 4/2016 Williams et al.
9,308,974 B1 * 4/2016 Randall ..... D06F 57/12
9,434,451 B1 9/2016 Ostmeyer et al.
9,446,818 B2 9/2016 Dougherty
9,896,036 B2 2/2018 Baxter
9,901,218 B2 * 2/2018 Fill ..... A47B 69/00
D828,359 S 9/2018 Burmester
10,220,916 B2 3/2019 Hooper
10,246,029 B2 * 4/2019 Brotherton ..... H02G 3/04
10,286,982 B2 5/2019 Sheedy
D852,805 S 7/2019 Lyu
10,407,131 B1 9/2019 Ward
2005/0258321 A1 11/2005 Worrall et al.
2006/0037527 A1 2/2006 Aff
2007/0062992 A1 * 3/2007 Hepworth ..... B60R 9/08 224/406
2008/0106113 A1 5/2008 Erskine et al.
2010/0038505 A1 * 2/2010 Sonnenberg ..... F16M 11/041 248/226.11
2011/0147425 A1 6/2011 Di Miceli
2013/0105662 A1 5/2013 Cote
2015/0076300 A1 * 3/2015 Eboli ..... F16B 2/06 248/214
2016/0280114 A1 9/2016 Baxter
2019/0193818 A1 6/2019 Oh
2019/0210663 A1 7/2019 Binley

* cited by examiner

WATER SPORTS BOARD RACK

This application claims domestic priority to U.S. Provisional Application 62/675,544 filed May 23, 2018, which is incorporated herein by this reference.

FIELD OF THE INVENTION

The present invention relates to racks for water sports boards, and more specifically to a rack for holding a wakesurf board and mountable to a support member on a ski boat.

DISCUSSION OF THE BACKGROUND

Watersports which utilize boards (e.g., water skis, kneeboards, wake boards, and more recently wakesurf boards) pulled behind a boat (e.g., a ski boat) are becoming more accessible and more popular. Newer boats often have a large capacity for passengers, with each passenger potentially bringing their own board(s) to ride. Thus, there is often a large number of boards which must be stowed on the boat tower when they are not in use. One option for utilizing space on a boat is to stack extra boards on the deck between seats. However, boats are also expected to carry life vests, towels, and coolers for its passengers, putting storage area for extra boards at a premium. Further, because a ride on a boat typically involves intentional sharp turns, high wind speeds, and a jarring up-and-down path through waves, unsecured boards may sustain damage or become a safety hazard to the boat's occupants.

Current methods for storing watersports boards off of the boat's deck include the use of forked racks attached either to the side of the boat or to an overhead support tower. These racks generally have rigid metal tines whose position cannot be adjusted to tighten down on a board. Such tines have little surface area and no padding to contact and support the board. The often fragile and expensive boards are thus able to rattle around in the racks while the boat is in motion, becoming damaged over time from rough contact with the tines. Furthermore, while wake boards and water-skis have foot-bindings which protrude from the surface of the board and help to prevent longitudinal movement in current racks systems, wakesurf boards have no such bindings and are thus more likely to fall out and/or sustain damage.

Also, the support towers of many boats are designed to fold down into the boat for transport and storage (e.g., support towers on Mastercraft boats). The upper cross-member and vertical side members of the support tower, where many current rack systems would ideally be attached, are thereby put into close proximity with the upholstery of the boat tower. Such upholstery is commonly made from leather or other materials which could easily be damaged by even light contact with a rigid metal edge. Current rack systems are generally high profile, with tines projecting 12 inches or more from the point of contact with the support tower. Further, attaching a rack to the outside of a support tower's side members may prevent the support tower from fully folding down due to contact with side of the boat.

Therefore, what is needed is a rack system for stowing watersports boards off of the deck of a boat, the rack having sufficient padding and securing straps to hold the board in place without damaging it while the boat is in motion, and a low profile to prevent damaging the boat when attached to a folding support tower.

SUMMARY OF THE INVENTION

The present invention provides a watersports board rack for attaching to a support member (e.g., a cross bar of an overhead wakeboard tower, or alternatively the support beams forming the sides of a wakeboard tower) of a boat. The rack may have improved padding and an increased contact area compared to current rack systems, as well as a thin profile to minimize the overhead space occupied by the rack to allow for sufficient headroom below the rack. The rack may also be operable to securely hold up to two watersports boards (e.g., two wakesurf boards) without the usual wear and tear (e.g., dents and scrapes) that occurs from regular contact with the tines of current rack systems.

The rack may also increase the boat's capacity to store securely store watersports boards while the boat is in motion, preventing the clutter and safety hazard of storing boards on the deck of the boat. Unlike current rack systems which may extend over a foot from an attachment point on a support member, the low-profile rack of the present invention may allow boards to be stored overhead. The rack may have a coupling mechanism which is operable to attach to an overhead cross-member of the support tower with minimal reduction in headroom. The rack system may alternatively be attached to one of the side support beam of the wakeboard tower.

A coupler and an adjustable bracket may be used in combination to attach the base plate to an overhead cross-member of the support tower without significant displacement of any soft top which may be stretched over the support tower. Unlike current rack systems, the present invention may therefore also help to prevent sun damage to the board(s) secured thereto (e.g., from ultraviolet rays), as the boards may be stored in the shade provided by the soft top. In some embodiments, the adjustable bracket may be a plate-like structure that can be securely attached to the coupler, and adjustably connected to the baseplate. For example, and without limitation, the adjustable bracket may have a plurality of curved slots arranged in arches equidistantly positioned relative to the center point of the adjustable bracket. These slots may be operable to receive connecting fasteners (e.g., bolt and nut, or other device) from the base plate. The curved, arch-like slots allow the base plate to be rotated relative to the adjustable bracket and coupler, thereby allowing the user to position the base plate in a range of angles relative to the coupler before tightening down the connecting fasteners. This feature may be utilized, e.g., if the overhead cross-beam of the tower has a curve or bend therein that would position the base plate such that a board attached thereto points obliquely, away from the front of the boat. An oblique orientation of the baseplate and attached board may create drag, and is thus undesirable. The adjustable bracket allows the base plate to be adjusted and oriented such that the attached water sports board is aligned parallel with the boat.

In further examples, the adjustable bracket may provide an offset radius from the coupler such that the center of the base plate may be offset from the coupler. For, example, and without limitation, adjustable bracket may have an elongate structure with an offset arm having a length in a range of about three inches to about 15 inches (e.g., about 4 inches to about 12 inches, about 5 inches to about 10 inches, or any value or range of values therein). The adjustment bracket may have a first attachment point for connecting to the coupler that is located at one end of the offset arm and a second attachment point for connecting to the base plate at a second end of the offset arm. The first attachment point, the adjustment bracket may include a plurality of holes allowing the coupler (e.g., via fasteners such as nut and bolt fasteners, locking pins, etc.) to be attached to the adjustable plate at various angles. In such examples, the plurality of holes may allow the adjustable bracket to be positioned relative to the coupler such that the offset arm may be positioned at incremental angles (e.g., in increments of about 30°, about 45°, about 90°, etc.) relative to the longitudinal axis of the boat, e.g., at about 0°, at about 30°, about 45°, about 60°, about 90°, about 120°, about 135°, about 150°, about 180°, about 210°, about 225°, about 240°, about 270°, about 300°, at about 315°, and at about 330°. The offset arm may allow more positioning options for the base plate to accommodate different boat tower designs while avoiding contact or damage to the interior of the boat when the boat tower is collapsed. The offset arm may also allow the base plate position to be adjusted to accommodate other structures mounted on the boat tower, such as speakers.

In such examples the second attachment point of the adjustable bracket may be a plate-like structure that can be adjustably connected to the baseplate. The second attachment point may have a plurality of curved slots arranged in arches equidistantly positioned relative to the center point thereof. These slots may be operable to receive connecting fasteners (e.g., bolt and nut, or other device) from the base plate. The curved, arch-like slots allow the base plate to be rotated relative to the second attachment point, thereby allowing the user to position the base plate in a range of angles relative to the second attachment point before tightening down the connecting fasteners. This feature may allow the base plate to be positioned such that it positions a board attached thereto in alignment with the longitudinal axis of the boat. For example, and without limitation, where the offset arm is positioned at 45° relative to the longitudinal axis of the boat, the base plate may be positioned at 135° relative to the offset arm such that the length of a board attached to the base plate will be parallel to the longitudinal axis of the boat. This adjustability of the attachment angle of the base plate to the second attachment point allows the user to avoid the drag that may result from an oblique or perpendicular orientation of the board.

In some embodiments, the rack system may include a quick release mechanism for quickly releasing the base plate from the adjustable plate. For example, the base plate may include a slot connector attached thereto having a protrusion having a first shape (e.g., a trapezoidal prism, elliptical prism, cylinder, etc.) that can be inserted or slotted into a receiver having a complementary shape positioned on the adjustable bracket. The slot connector may also include a locking bolt, latch, pin, or other securing member that secures the protrusion in the receiver once the protrusion is fully inserted into the receiver. For example, the slot connector of the base plate and the receiver may have securing member holes for receiving the securing member than are aligned with one another when the protrusion is fully inserted into the receiver. The securing member may be inserted into the securing member holes when the holes are aligned, thereby securing the protrusion and receiver in position. In some examples, the securing member may include an R-clip or cotter pin that prevents the securing member from dislodging from the securing member holes.

In some examples, and without limitation, the position of the receiver may be adjustable relative to the adjustment bracket to allow the base plate to be oriented at varying angles. For example, and without limitation, the receiver may have a receiver plate for attachment to the adjustable bracket, and the adjustable bracket may have a plurality of curved slots arranged in arches equidistantly positioned relative to the center point thereof. These slots may be operable to receive connecting fasteners (e.g., bolt and nut, or other device) from the receiver plate. The curved, arch-like slots allow the receiver plate to be rotated relative to the adjustable bracket, thereby allowing the user to position the receiver such that the base plate can be positioned in a range of angles relative to the adjustable bracket before tightening down the connecting fasteners.

In some embodiments, and without limitation, the quick release mechanism may be paired with the adjustable bracket having the offset arm. In such examples, the second attachment point of the adjustable bracket may be a plate-like structure that can be adjustably connected to the receiver plate. The second attachment point may have a plurality of curved slots arranged in arches equidistantly positioned relative to the center point thereof. These slots may be operable to receive connecting fasteners (e.g., bolt and nut, or other device) from the receiver plate. The curved, arch-like slots allow the receiver plate to be rotated relative to the second attachment point, thereby allowing the user to position the receiver plate in a range of angles relative to the second attachment point before tightening down the connecting fasteners. This feature may allow the receiver plate to be positioned such that it positions a board attached to base plate (which is attached to the receiver plate via the quick release mechanism) in alignment with the longitudinal axis of the boat. For example, and without limitation, where the offset arm is positioned at 45° relative to the longitudinal axis of the boat, the receiver plate may be positioned at 135° relative to the offset arm such that the length of a board attached to the base plate will be parallel to the longitudinal axis of the boat. This adjustability of the attachment angle of the receiver plate relative to the second attachment point allows the user to avoid the drag that may result from an oblique or perpendicular orientation of the watersports board.

Finally, for boats having a support tower which folds down, the current invention can remain installed on the tower during transport and storage with the tower in a collapsed stowed configuration, without contacting or damaging the interior of the boat. The low profile and relatively small dimensions of the present invention may allow it to remain attached to a cross-member of the tower while in the collapsed position without coming in contact with the upholstery of the boat, preventing tears and indentions. Thus, the rack of the present invention may save a user the time and hassle of removal and re-installation every time the boat is taken out of the water. Support towers and boats both vary in their shape and design. There may be boat and tower combinations in which the base plate may contact a seat or other structure or surface inside such boat, despite the low-profile, minimized area design. In such situations, the quick release mechanism may be employed to quickly remove the base plate from the tower so that the tower can be collapsed and stowed. The quick release may greatly reduce the hassle of getting the boat in condition for storage, and makes removing the coupler from the tower unnecessary.

The present invention may provide a rack system operable to be safely securing a watersports board to an overhead support member of a boat. The rack system may comprise a base plate, a pad for providing cushion, a securing device for securing the watersports board against the pad, an adapter, and a coupler operable to attach the rack system to an overhead support member of the boat.

The base plate may comprise a sturdy, rigid material operable to maintain its shape while supporting the weight of at least one watersports board during recreation boating activities (e.g., sharp turns, high winds, and rough passage through waves). In some embodiments, the base plate may comprise at least one of a metal, a metal alloy, a plastic, carbon fiber, and other similar rigid materials. In some embodiments, the base plate may comprise a rigid material having a flat and relatively thin profile (e.g., in a range of about 1/16 inch to about 1/2 inch thick, and preferably in a range of about 1/8 inch to about 1/4 inch thick). The material of the base plate may be a metal (e.g., stainless steel, aluminum, etc.) or a composite material. In some embodiments, the base plate may comprise a shape having a slight curve, the slight curve being complementary to a shape of a watersports board to maximize interfacing contact between the board and the base plate.

The base plate may comprise an attachment element for attaching a securing device to the base plate. In some embodiments, the attachment element may comprise a first slot and a second slot, the first and second slots each traversing the base plate and providing a passage therethrough. The first and second slots may be oriented substantially parallel to each other and closely spaced such that a securing device may be attached to the base plate by passing an end thereof through the first slot in a first direction and back through the second slot in a second direction. In other embodiments, the attachment element may comprise at least one of a buckle, a tie-down, an arch, a hook, a snap, a tab, and other similar attachment devices operable to secure a strap or cord to the base plate.

In some embodiments, the attachment element may comprise a plurality of attachment elements. In some embodiments, the plurality of attachment elements may comprise a first attachment element and a second attachment element, the first and second attachment elements positioned near opposing edges of a base plate having a substantially rectangular shape or outline (e.g., the edges positioned nearest the bow and the stern of the boat, or the edges positioned nearest the port and starboard sides of the boat). In some embodiments, the first attachment element may attach a first securing device to the base plate and the second attachment element may attach a second securing device to the base plate. In other embodiments, a single securing device may be attached to the base plate at both the first attachment element and the second element.

In other embodiments, the plurality of attachment elements may comprise four attachment elements, one attachment element at each corner of a base plate having a substantially rectangular, or a base plate having at least four outer corners. In such embodiments, a first attachment element and a second attachment element may each attach a first securing device to the base plate, and a third attachment element and fourth attachment element may each attach a second securing device to the base plate.

The base plate may have a width which is approximately equal to or slightly greater than a width of a typical wake surfboard secured thereto, such that the base plate is no wider than required to safely secure the board. For example a distance between the first attachment element and the second attachment element may be approximately equal to or slightly greater than a width of the watersports board (e.g., the width of the board spanning the distance between the first and second attachment elements), and the distance between the third attachment element and fourth attachment element may also be approximately equal to or slightly greater than the width of the watersports board (e.g., the width of the board spanning the distance between the third and fourth attachment elements).

In other embodiments, at least one of the distance between the first and second attachment elements and the distance between the third and fourth attachment elements may be slightly less than an adjacent width of the board secured thereby. In some embodiments, the base plate may have a length which is substantially less than the length of the secured board, such that the base plate is no longer than required to safely secure the board.

In some embodiments, the base plate may comprise a substantially rectangular shape with extensions at or near each of the four corners, the extensions each comprising an attachment element for attaching a securing device to the base plate. In other embodiments, the base plate may comprise a stylized X shape having four extensions, one extension at or near each corner of the X shape, the extensions each comprising an attachment element for attaching a securing device to the base plate. In yet other embodiments, the base plate may comprise a substantially rectangular outer shape with one or more cut-out shapes in order to reduce the weight of the rack. In some embodiments, the base plate may comprise at least one of polygonal shape, an oval shape, a circular shape, and other similar shapes. The interfacing area of the base plate (the area against which a watersports board is positioned may have a width in the range of about 17 inches to about 22 inches (e.g., about 19 inches) for accommodating the width of a wake surfboard, and a may have a length in the range of about 15 inches to about 18 inches. The size (particularly the length) of the interfacing area may allow the tower or other overhead structure to which the base plate is attached to be lowered into a collapsed storage position, such that the base plate does not contact the interior structures or surfaces of the boat (e.g., seats, compartments, etc.), thereby preventing damage to the seats or other interior features of the boat. As a result, the watersports board rack can remain installed on the tower of the boat even when the tower is lowered, and the user can avoid the need to remove the rack when the boat is to be stored with the tower lowered or collapsed. Additionally, the base plate may have a low profile thickness in a range of about 1/8 inch to about 1/4 inch thick, such that it can sit directly below an overhead crossbeam of the tower with a watersports board attached thereto without any significant loss in headroom below the tower.

The pad may comprise a layer of strong but compressible material operable to provide a cushion between the base plate and the secured watersports board. The pad may comprise a material operable to compress somewhat in order to avoid damage to the surface of the watersports board, but being sufficiently rigid to avoid jostling or displacement of the board while the boat is in motion, securely holding in the rack during recreational boating activities. In some embodiments, the pad may comprise at least one of an ethylene-vinyl acetate (EVA) material, a polyethylene closed cell foam material (e.g., PeLite), a rubber, a foam rubber, a latex, a polyurethane, a polystyrene, and other similar cushioning materials. In some embodiments, the pad may comprise a plurality of materials, each having a different level of compressibility.

The pad may comprise a thickness no greater than necessary to provide cushion and prevent damage to a watersports board secured in the rack of the present invention, so as to avoid unnecessary weight or thickness in the rack. In some embodiments, the thickness of the pad may depend upon the type of material that the pad is made from (e.g., more compressible materials may require greater thickness, while more rigid materials require less thickness to provide sufficient cushion to a secured board.) In some embodiments, the pad may comprise a thickness in a range of approximately 2 mm to approximately 10 mm, and preferably in a range of approximately 4 mm to approximately 8 mm. In some embodiments, the pad may comprise an EVA material having a thickness in a range of approximately 4 mm to approximately 8 mm (e.g., approximately 6 mm).

The pad may comprise a shape complementary to a shape of the base plate such that the pad covers a substantial portion of a surface of the base plate which may contact a secured board (e.g., a substantially rectangular pad for covering a substantially rectangular base plate, a stylized X shaped pad for covering a stylized X shaped base plate, etc.). In some embodiments, the pad may not cover any areas of the base plate which hold an attachment element in order to prevent rubbing between the securing device and the pad. In some embodiments, the pad may comprise a plurality of separate distinct pads, each adhered to a surface of the base plate.

The pad may be attached to the surface of the base plate which faces a watersports board secured thereto. In some embodiments, the pad may be attached to the base plate via an adhesive (e.g., a glue or other adhesive formulation) capable of keeping the pad secured to the base plate through the stresses induced while a watersports board is secured in the rack during recreational boating activities. In some embodiments, the adhesive may comprise a commercially available textile adhesive. In other embodiments, the pad may be attached to the base plate via a mechanical attachment mechanism, such as a hook and loop material (e.g., Velcro), a screw, a bolt, a clamp, and other similar fastening devices.

The securing device may comprise any device operable to secure a watersports board against the pad of the present invention during recreational boating activities. The securing device may be attached to the base plate via the attachment element, as further described herein. In some embodiments, the securing device may comprise a strap. In some embodiments, the strap may comprise a woven material having a tightening element operable to tighten the strap (e.g., shorten the length of the strap under tension) around a watersports board. The tightening element may comprise at least one of a buckle, a snap-buckle, a cam buckle, a tie-down, a strap tensioner, a tension lock, a snap, and other similar devices. The strap may further comprise a strap pad positioned between the tightening element and the secured watersports board so as to prevent damage from contact between the board and the tightening element (e.g., damage from a metal strap tensioner rubbing against the board). In some embodiments, the strap pad may comprise the same material as the strap, with an expanded shape and/or thickness. In other embodiments, the strap pad may comprise a cushioning material, such as a microfiber pad, an EVA pad, Neoprene pad, or other cushioning material. The strap pad may be slidably engaged with the strap (e.g., with the strap nested inside the strap pad, to allow the strap pad to be moved for access to the tightening element and then moved back over the tightening element to protect the surface of the board.

In other embodiments, the securing device may comprise a cord (e.g., a bungee cord) or a band (e.g., an resilient band, one comprising elastics). In yet other embodiments, the securing device may comprise set of clamps or clips positioned on the perimeter of the base plate that can apply sufficient pressure to the board to keep it in position against said base plate during movement of the boat. The clamps or clips may be padded to protect the surface of the board. In other embodiments, the securing device may include jointed clamps or tabs at the perimeter of the base plate (e.g., connected to the base plate by hinge joints) that connect with a strap for tightening or closing the clamps or tabs snuggly over the lateral edges of the board. In such embodiments, the strap may not contact or apply significant pressure to the surface of the board, and the clamps or tabs may be padded to secure a watersports board during recreational boating activities without damage.

In some embodiments, the securing device may comprise a plurality of securing devices. In some embodiments, the plurality of securing devices may comprise a first strap having a first tightening element and a second strap having a second tightening element, the first strap being secured to the base plate via a first and second attachment elements, and the second strap being secured to the base plate via a third and fourth attachment elements.

The rack may be operable to securely hold both a first watersports board and a second watersports board (e.g., two wakesurf boards) during recreational boating activities. In some embodiments, a first watersports board may be put in contact with the pad of the rack, and a second watersports board may be layered on the first watersports board (e.g., below the first watersports board if the rack is attached to an overhead support member), and then the securing device may be tightened around the second watersports board, securely holding both the first watersports board and the second watersports board to the rack.

The coupler may be operable to secure the rack of the present invention to a support member of a boat (e.g., a beam of a support tower). In some embodiments, the coupler may comprise an outer rigid structure (e.g., a metal structure) and an inner cushioning layer (e.g., Vulcanized rubber, EVA material, etc.). The coupler may comprise an inner aperture having a shape complementary to the cross-sectional shape of the boat's support member. In some embodiments, the inner aperture of the coupler may comprise a hollow, substantially cylindrical shape complementary to the shape of a cylindrical support member of the boat (e.g., a round bar or post). In other embodiments, the coupler may comprise an inner surface with a complementary shape for clamping onto a support member with other cross-sectional shapes, such as polygonal, elliptical, Reuleaux triangle or other rounded polygonal shapes, etc.

In some embodiments, the body of the coupler may have a hinge joint to allow the inner aperture of the coupler to be opened, and placed around and engaged with a support structure (e.g., a bar, beam, etc.) of the tower. For example, the coupler may include a hinge joint on a superior side (a first side) thereof, opposite the side of the coupler for attaching to the base plate. The coupler may also include a locking device on an opposite side (a second side) of the inner aperture, allowing the coupler to be opened and placed around the support member of the boat and then closed and locked down via the locking device. In some embodiments, the locking device may comprise at least one of a screw, a bolt, a lever, a clip, a pin, and other similar devices for keeping the coupler in a closed, locked position. The dimensions of the coupler may be such that the thickness of the second side (e.g., the thickness of the coupler structure between the support structure of the tower and the base plate) is very small, such that the coupler allows the base plate to be positioned as close as possible to the support structure of the tower and only minimally reduces the headroom below the tower for the occupants of the boat.

In some embodiments, the rack system may additionally include an adjustable bracket that connects to the coupler and the base plate, as discussed above. In some embodiments, the adjustable bracket may be a plate-like structure that can be securely attached to the coupler, and adjustably connected to the baseplate. For example, and without limitation, the adjustable bracket may have a plurality of curved slots arranged in arches equidistantly positioned relative to the center point of the adjustable bracket. These slots may be operable to receive connecting fasteners (e.g., bolt and nut, or other device) from the base plate. The adjustable bracket may have an offset arm as described above.

The coupler or adjustable bracket may be attached to the base plate on the opposite side of the base plate from the pad (e.g., the side which does not contact the secured watersports board). In some embodiments, the coupler may comprise a bracket for attaching to the base plate. The bracket may comprise a plurality of apertures for passing an end of an attachment device (e.g., a screw or bolt) through the bracket and into a complementary aperture in the base plate (e.g., a hole with threading complementary to the threading of a screw or bolt). In other embodiments, the base plate may be indirectly attached to the coupler via the adjustable bracket.

In some embodiments, the present invention may provide a method for using a rack for securing watersports boards to a support member of a boat during recreational boating activities. In some embodiments, the method may comprise the steps of: attaching the rack to an overhead support member of the boat tower via a coupler; putting a watersports board in contact with the pad of the rack; and tightening a securing device around the watersports board. In some embodiments, the method may further comprise the step of: adjusting an angle of a base plate relative to the longitudinal axis of a boat. In some embodiments, the method may further comprise the step of: adjusting the orientation of an adjustable bracket relative to the coupler. In some embodiments, the method may further comprise the step of: tightening a second securing device around the watersports board. In some embodiments, the method may further comprise the step of: folding the boat tower down for transportation or storage without the rack or the watersports board contacting interior structures or surfaces of the boat (e.g., seats, benches, compartments, etc.).

In other embodiments, the method may comprise the steps of: attaching a water sports board rack to an overhead support member of the boat tower via a coupler; putting a first watersports board in contact with the pad of the rack; putting a second watersports board in contact with the first watersports board; and tightening a securing device around the first and second watersports boards. In some embodiments, the method may further comprise the step of: tightening a second securing device around the first and second watersports boards. In some embodiments, the method may further comprise the step of folding the boat tower down for transportation or storage. In some embodiments, the method may further comprise the step of: adjusting an angle of a base plate relative to the longitudinal axis of a boat. In some embodiments, the method may further comprise the step of: adjusting the orientation of an adjustable bracket relative to the coupler.

Further objects and aspects of the present invention will be apparent from the description provided herein.

DETAILED DESCRIPTION OF THE DRAWINGS

Figure 1A:
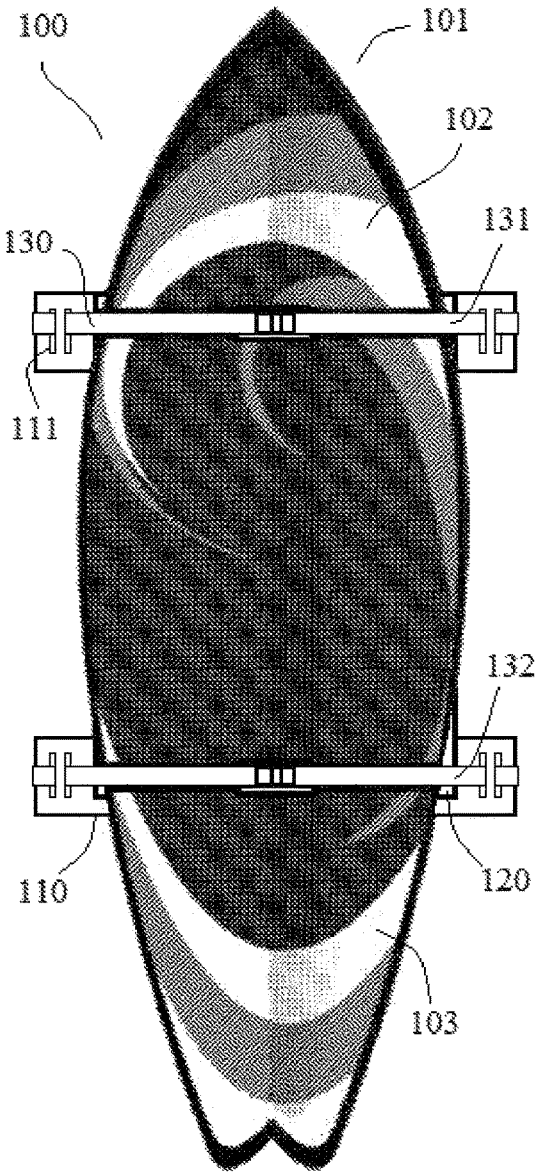
FIG. 1A shows a top-down view of a watersports board rack with a watersports board secured thereto, according to an embodiment of the present invention.

Reference will now be made in detail to certain embodiments of the invention, examples of which are illustrated in the accompanying drawings. While the invention will be described in reference to these figures and certain implementations and examples of the embodiments, it will be understood that such implementations and examples are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. References to various features of the "present invention" throughout this document do not mean that all claimed embodiments or methods must include the referenced features. It will be apparent to one skilled in the art that the present invention may be practiced without these specific details or features.

Reference will be made to the exemplary illustrations in the accompanying drawings, and like reference characters may be used to designate like or corresponding parts throughout the several views of the drawings.

Figure 1B:
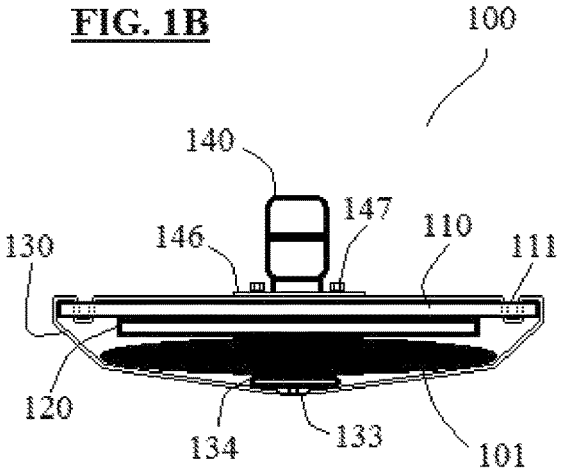
FIG. 1B shows a front side view of a watersports board rack with a watersports board secured thereto, according to an embodiment of the present invention.
Figure 1C:
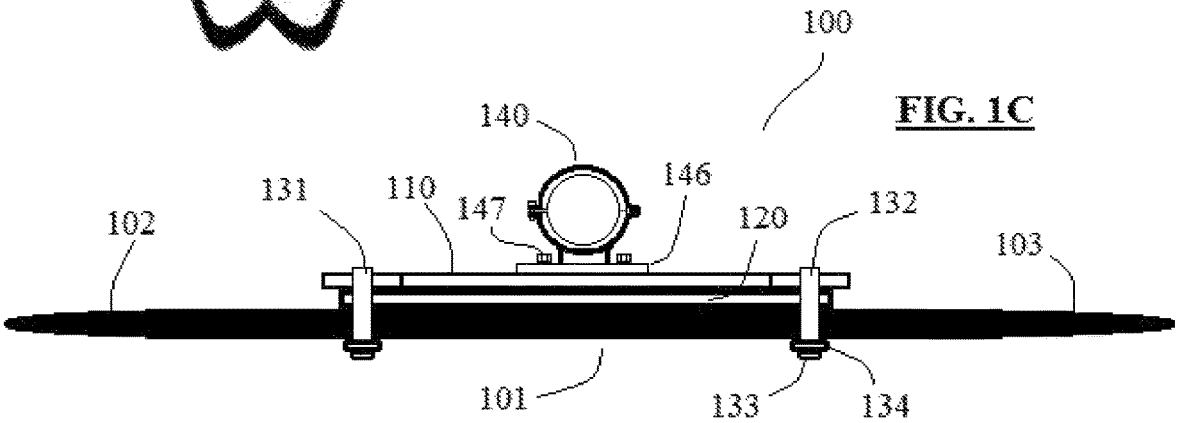
FIG. 1C shows a side view of a watersports board rack with a watersports board secured thereto, according to an embodiment of the present invention.

As seen in FIGS. 1A-1C, the present invention provides a watersports board rack 100 for securing a watersports board 101 to a support member (e.g., an overhead support tower) of a boat. The rack 100 may comprise a base plate 110, a pad 120 for providing cushion, a securing device 130 for securing the watersports board 101 against the pad 120, and a coupler 140 for attachment to the support member of the boat.

The base plate 110 may comprise metal plate having a flat and relatively thin profile (e.g., in a range of about ⅛ inch to about ¼ inch thick). The securing device 130 may comprise a first strap 131 and a second strap 132. The first strap 131 may be positioned to secure a first end 102 of the watersports board to the base plate 110, and the second strap 132 being positioned to secure a second end 103 of the watersports board to the base plate 110. The base plate 110 may comprise a plurality of attachment elements 111 for attaching the first strap 131 and the second strap 132 to the base plate 110. The attachment elements 111 may each comprise a first slot and a second slot, the first and second slots each traversing the base plate 110, allowing the securing device 130 to attach to the base plate 110 by being routed therethrough.

The base plate 110 may comprise a width which is comparable to the width of the watersports board 101, and a length which is substantially smaller than the length of the watersports board 101, such that the base plate is no wider or longer than required to safely secure the watersports board to the boat. The length of the base plate may be of a length that allows the tower or other overhead structure to which the base plate is attached to be lowered into a stored position with the base plate attached, without the base plate contacting the interior structures or surfaces of the boat.

Figure 2A:
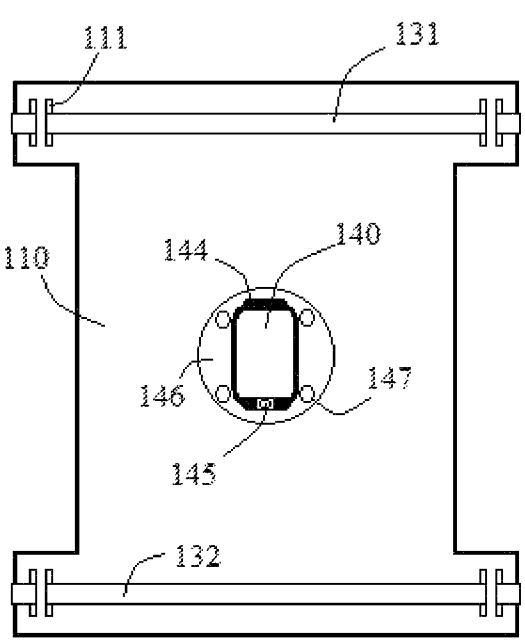
FIG. 2A shows a top-down view (left) and a bottom-up view (right) of a watersports board rack, according to an embodiment of the present invention.
Figure 2A:
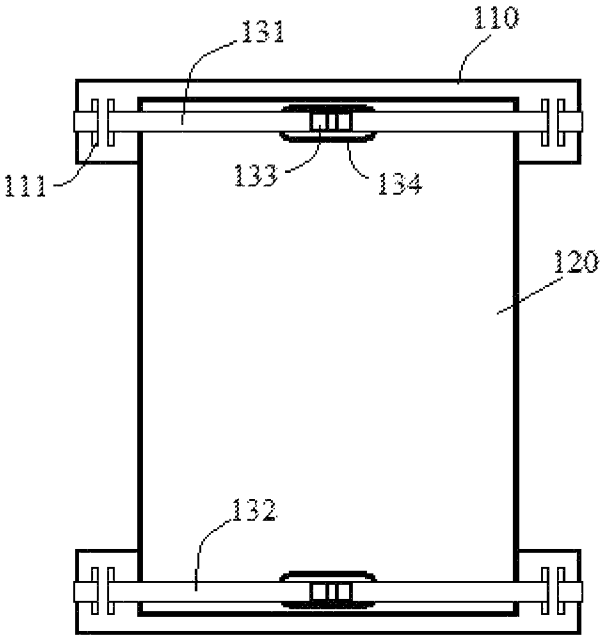
Figure 2B:
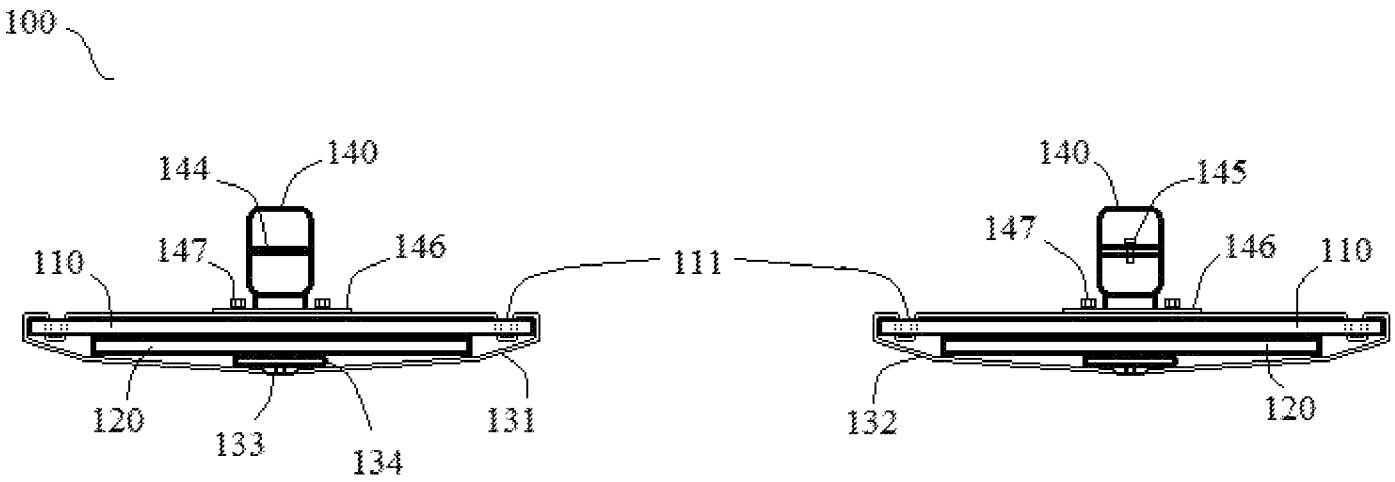
FIG. 2B shows a front view (left) and a rear view (right) of a watersports board rack, according to an embodiment of the present invention.
Figure 2C:
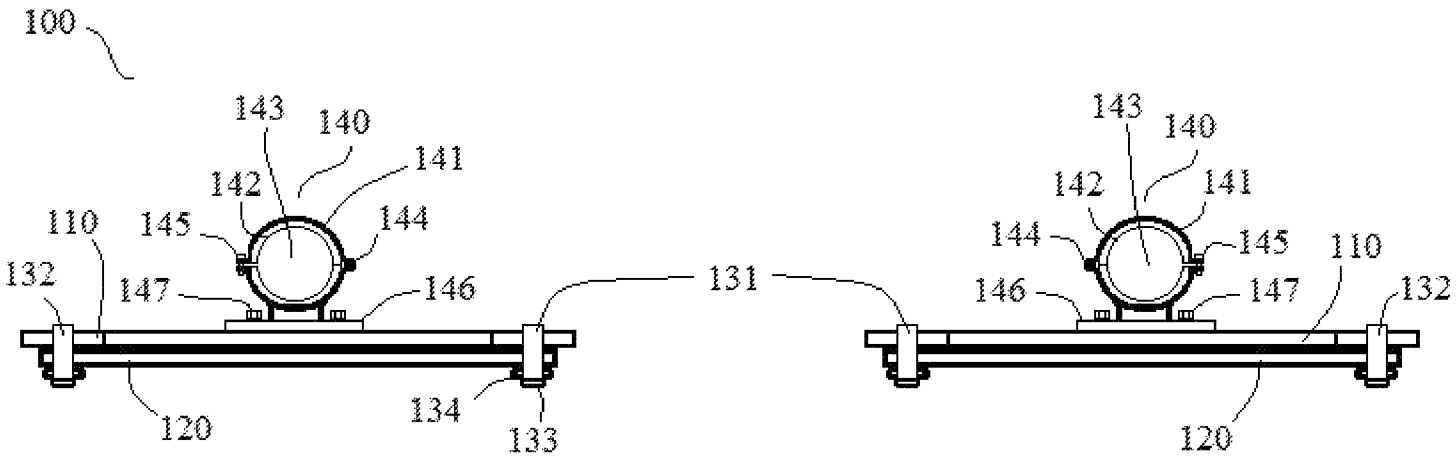
FIG. 2C shows a right side view (left) and a left side view (right) of a watersports board rack, according to an embodiment of the present invention.

Referring now to FIGS. 2A-2C. FIG. 2A provides a top-down view (right) and a bottom-up view (left) of a base plate 110, according to an embodiment of the present invention. The base plate 110 may comprise rigid material (e.g., a metal, composite or other rigid material such as a milled metal—stainless steel, aluminum, etc.) and a substantially rectangular shape with extensions at each of the four corners, the extensions each comprising an attachment element 111 for attaching a securing device 130 to the base plate 110.

The pad 120 may comprise a layer of a padding material which is strong but somewhat compressible (e.g., vulcanized rubber, ethylene-vinyl acetate (EVA) material, etc.), and operable to provide a cushion between the base plate 110 and the secured watersports board 101. The pad 120 may comprise a thickness in a range of about 4 mm to about 15 mm (e.g., about 6 mm), such thickness being sufficient to provide cushion and prevent damage to the watersports board secured in the rack 100, but not so thick as to add unnecessary weight or overall thickness to the rack 100.

The pad 120 may comprise a substantially rectangular shape complementary to the shape of the base plate 110, such that the pad 120 covers a substantial portion of the surface of the base plate 110 which comes in contact with the secured watersports board 101. The pad 120 may not cover the extensions at the corners of the base plate 110 in order to prevent unnecessary rubbing between the securing device 130 and the pad 120.

FIG. 2B provides a front view (left) and a rear view (right) of a watersports board rack 100, according to an embodiment of the present invention. The first strap 131 and second strap 132 of the securing device 130 may each comprise a woven material and each may have a tightening element 133 operable to tighten the respective strap (e.g., shorten the length of the strap under tension) around a watersports board 101. The tightening element 133 may comprise a tension lock. The strap may further comprise a strap pad 134 positioned between the tightening element 133 and the secured watersports board 101 so as to prevent damage from contact between the board 101 and the tightening element 133 (e.g., damage from a metal strap tensioner rubbing against the board).

FIG. 2C provides a right side view (left) and a left side view (right) of a watersports board rack 100, according to an embodiment of the present invention. The coupler 140 may be operable to secure the rack 100 of the present invention to a support member of a boat (e.g., a beam of a support tower). As seen in FIG. 2C, the coupler 140 may comprise an outer rigid layer 141 (e.g., a metal layer) and an inner cushioning layer 142 (e.g., EVA material). The coupler 140 may comprise an inner aperture 143 having a shape complementary to the cross-sectional shape of the boat's support member (e.g., a hollow, substantially cylindrical shape complementary to the shape of a round cross-member of the boat tower). The coupler 140 may have a hinge 144 on a first side of the coupler 140 and a locking device 145 on a second side of the coupler 140, allowing the coupler 140 to swing open via the hinge 144, be placed around the support member of the boat, and then be closed and locked down via the locking device 145. The locking device may comprise a screw, bolt, or other fastening mechanism.

The coupler 140 may be attached to the base plate 110 on the opposite side of the pad 120 via a bracket 146. The bracket 146 may comprise a plurality of apertures for passing an end of an attachment device 147 (e.g., a bolt) through the bracket 146 and into a complementary aperture in the base plate 110 (e.g., a hole with threading complementary to the threading of the bolt).

Figure 3A:
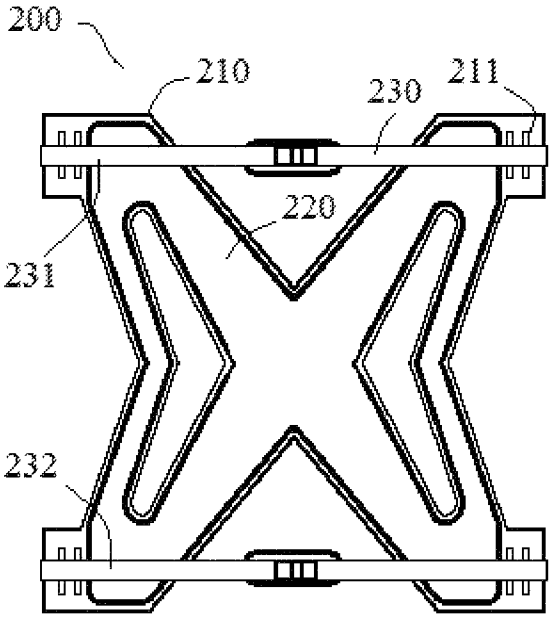
FIG. 3A shows a top-down view (left) and a bottom-up view (right) of a watersports board rack, according to an embodiment of the present invention.
Figure 3A:
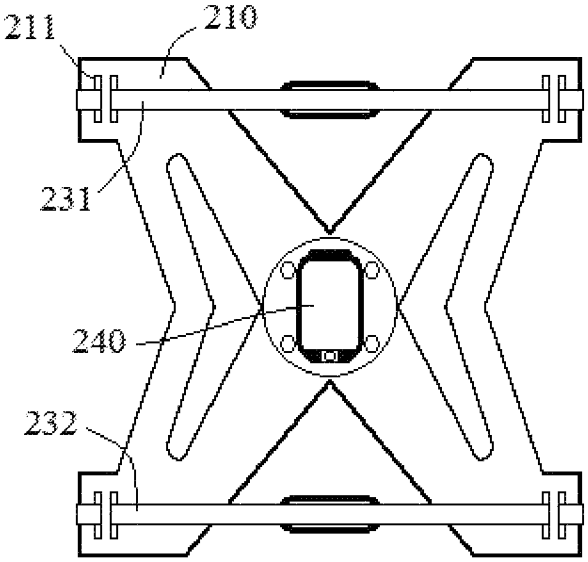

FIG. 3A provides a top-down view (left) and a bottom-up view (right) of a watersports board rack 200, according to an embodiment of the present invention. The rack 200 may comprise a base plate 210, a pad 220 for providing cushion, a securing device 230 comprising a first strap 231 and a second strap 232 attached to the base plate 210 via a plurality of attachment elements 211 for securing the watersports board 101 against the pad 220, and a coupler 240 for attachment to the support member of the boat. The base plate 210 may comprise a comprise a stylized X shape having four extensions, one extension at each corner of the X shape, the extensions each comprising an attachment element 211 for attaching a securing device 230 to the base plate 210.

Figure 3B:
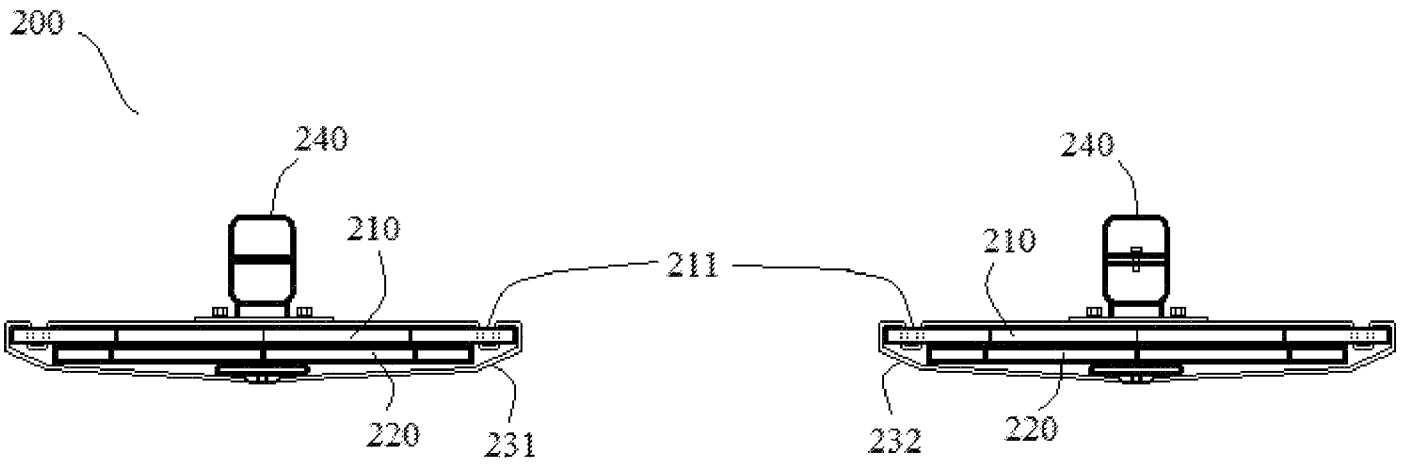
FIG. 3B shows a front view (left) and a rear view (right) of a watersports board rack, according to an embodiment of the present invention.
Figure 3C:
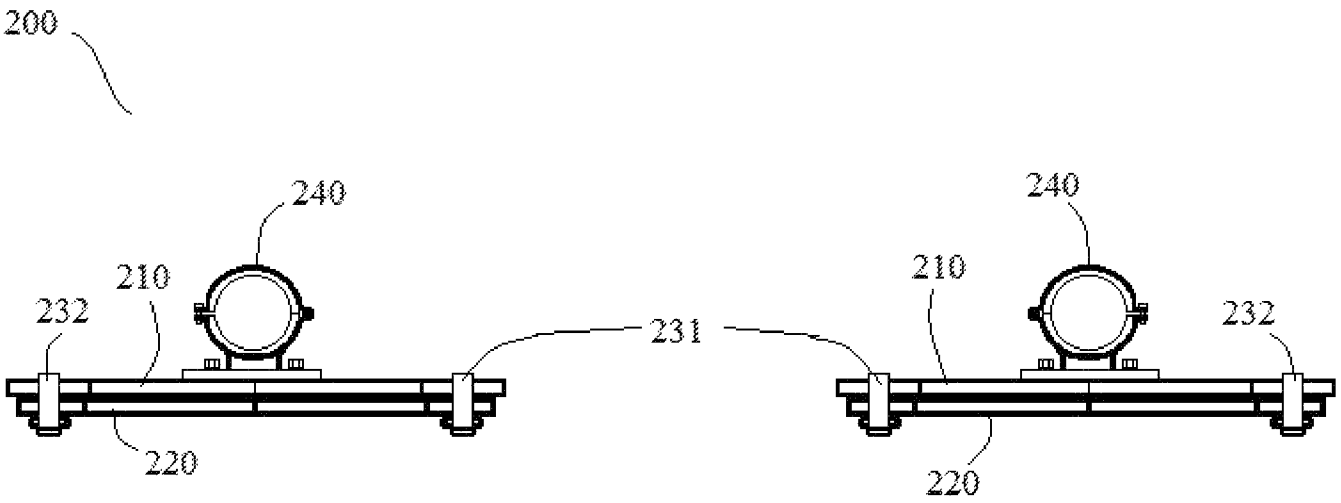
FIG. 3C shows a right side view (left) and a left side view (right) of a watersports board rack, according to an embodiment of the present invention.

FIG. 3B provides a front view (left) and a rear view (right) of a watersports board rack 200, and FIG. 2C provides a right side view (left) and a left side view (right) of a watersports board rack 200 according to an embodiment of the present invention. Further aspects of the embodiment shown in FIGS. 3A-3C may be similar in function and scope to the aspects of the embodiment shown in FIGS. 2A-2C.

Figure 4:
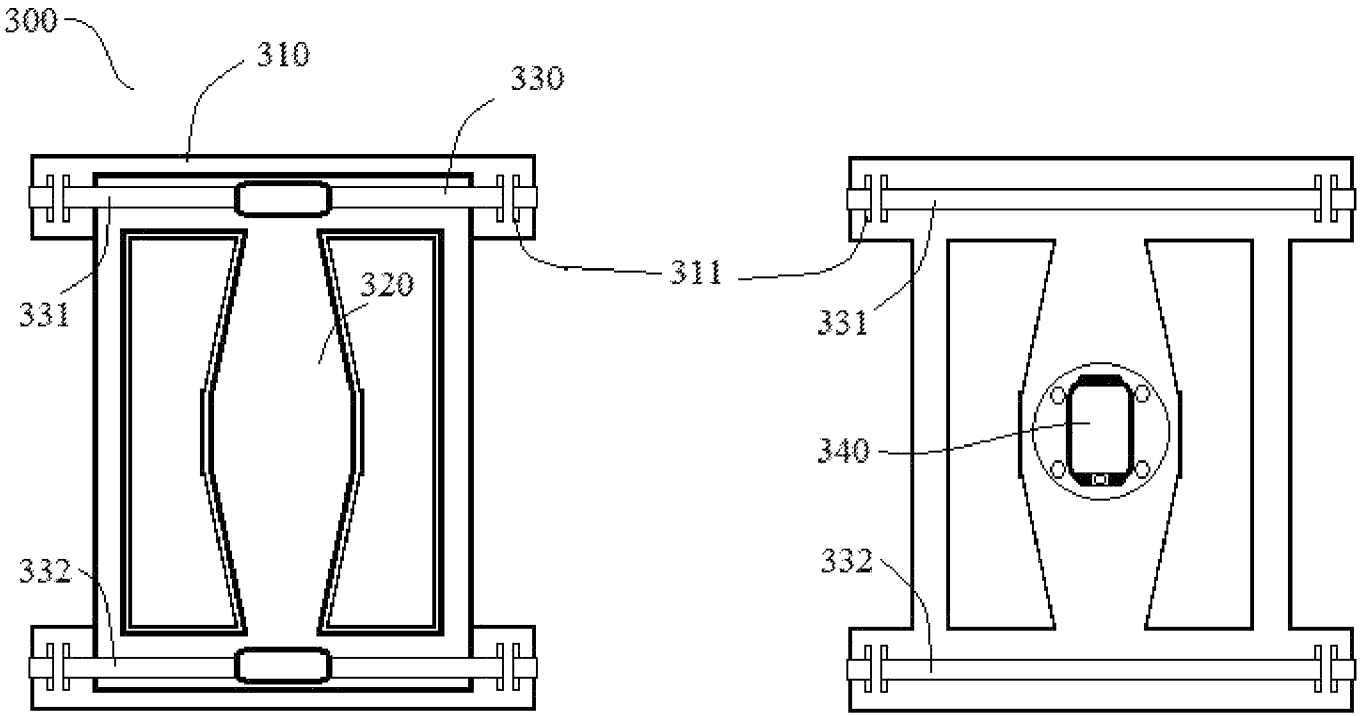
FIG. 4 shows a shows a top-down view (left) and a bottom-up view (right) of a watersports board rack, according to an embodiment of the present invention.

FIG. 4 provides a top-down view (left) and a bottom-up view (right) of a watersports board rack 300, according to an embodiment of the present invention. The rack 300 may comprise a base plate 310, a pad 320 for providing cushion, a securing device 330 comprising a first strap 331 and a second strap 332 attached to the base plate 310 via a plurality of attachment elements 311 for securing the watersports board 101 against the pad 320, and a coupler 340 for attachment to the support member of the boat. The base plate 310 may comprise a substantially rectangular outer shape with a plurality of open areas (e.g., cut-outs) and four extensions, one extension at each corner. The extensions may each comprise an attachment element 311 for attaching a securing device 330 to the base plate 310. Further aspects of the embodiment shown in FIG. 4 may be similar in function and scope to the aspects of the embodiment shown in FIGS. 2A-2C.

Figure 5:
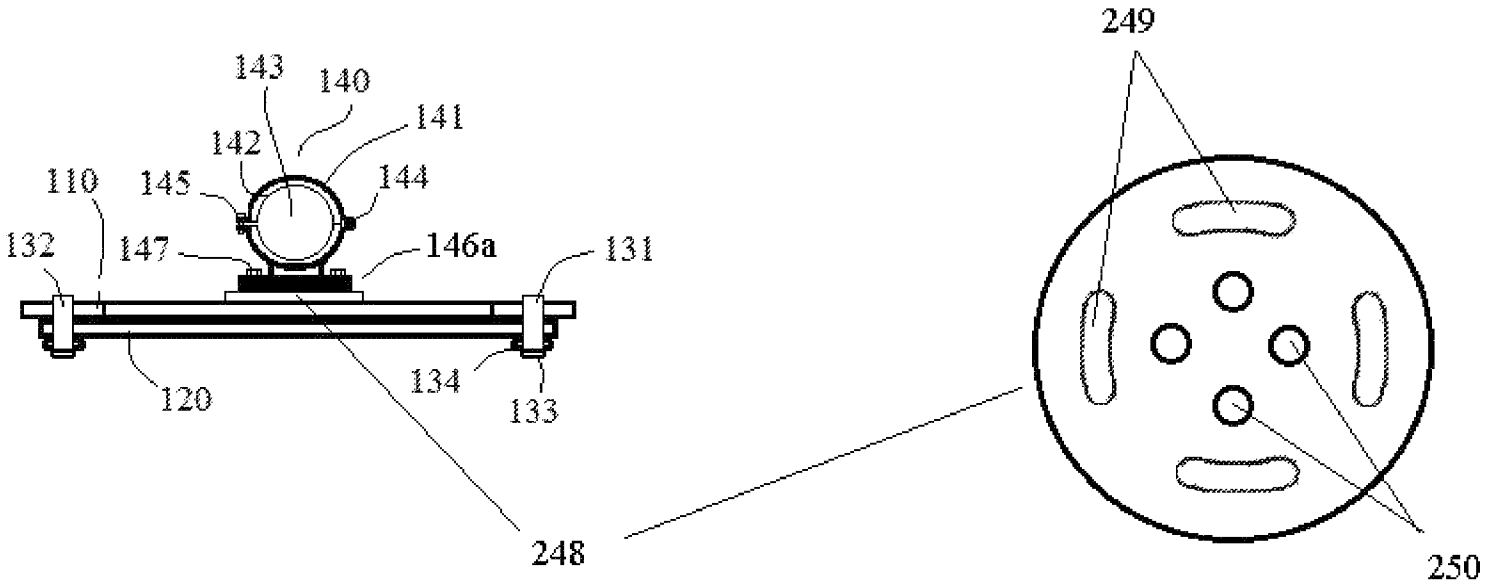
FIG. 5 shows a watersports board rack according to an embodiment of the present invention.

FIG. 5 shows a front view of a watersports board rack according to an embodiment of the present invention that is similar to that of FIGS. 2A-2C, having the same set of reference numbers and components, with some variations. The watersports board rack includes an adjustable bracket 248 that is operable to mechanically connect to bracket **146*a* of the coupler 140. The adjustable bracket 248 may be operable to be mechanically connected to the base plate 110. The adjustable bracket 248 may include concentric rings of fastening slots 249 and fastening holes 250. The plurality of fastening holes 250 may be equidistantly positioned relative to the center point of the adjustable bracket 248, and may be operable to receive connecting fasteners 147 to mechanical connect the adjustable bracket 248 to the coupler 140. The plurality of curved fastening slots 249 may be equidistantly positioned relative to the center point of the adjustable bracket 248. These fastening slots 249 may be operable to receive connecting fasteners (e.g., bolt and nut, or other device) from the base plate 110. The curved, arch-like slots 249 allow the base plate 110 to be rotated relative to the adjustable bracket 248 and coupler 140, thereby allowing the user to position the base plate 110 in a range of angles relative to the coupler 140** before tightening down the connecting fasteners. This feature may be utilized, e.g., if the overhead cross-beam of the tower has a curve or bend therein that would position the base plate such that a board attached thereto points obliquely, away from the front of the boat. An oblique orientation of the baseplate and attached board may create drag, and is thus undesirable. The adjustable bracket allows the base plate to be adjusted and oriented such that the attached water sports board is aligned parallel with the boat.

Figure 6:
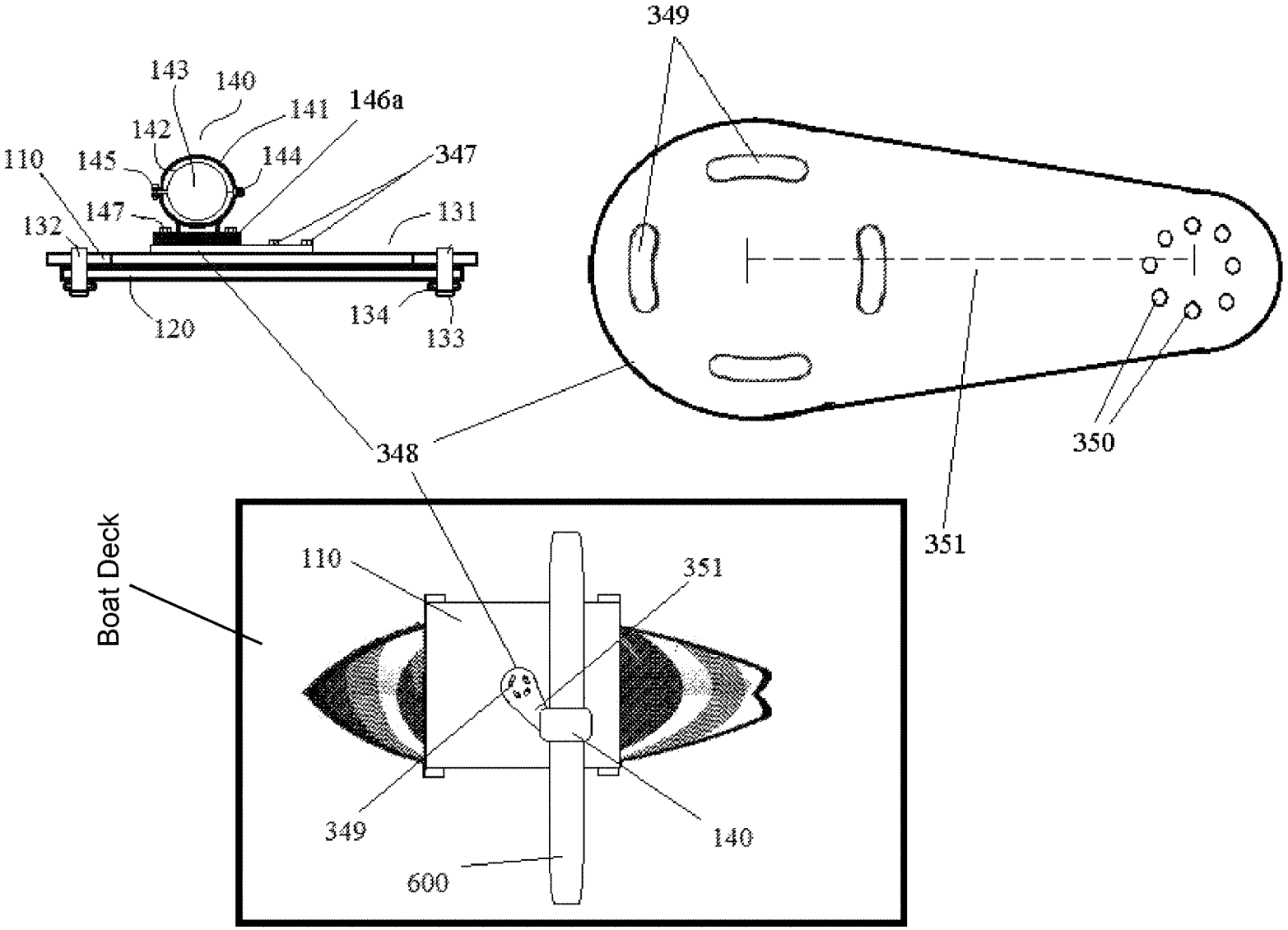
FIG. 6 shows a watersports board rack according to an embodiment of the present invention.

FIG. 6 shows a front view of a watersports board rack according to an embodiment of the present invention that is similar to that of FIGS. 2A-2C, having the same set of reference numbers and components, with some variations. The watersports board rack includes an adjustable bracket 348 having an offset arm 351. The adjustable bracket 348 may be operable to mechanically connect to bracket 146*a* of the coupler 140 and to mechanically connect to the base plate 110. The adjustable bracket 348 may include concentric ring of fastening slots 349 around a second attachment point and a concentric ring of fastening holes 350 around a first attachment point. The plurality of fastening holes 350 may be equidistantly positioned relative to the center point of the first attachment point, which may be a plate-like structure at a first end of the adjustable bracket 348. The plurality of fastening holes 350 may be operable to receive connecting fasteners 147 to mechanical connect the adjustable bracket 348 to the coupler 140. The plurality of curved fastening slots 349 may be equidistantly positioned relative to the center point of the second attachment point, which may be a plate-like structure at a second end of the adjustable bracket 348. These fastening slots 349 may be operable to receive connecting fasteners (e.g., bolt and nut, or other device) from the base plate 110. The curved, arch-like slots 349 allow the base plate 110 to be rotated relative to the adjustable bracket 248 and coupler 140, thereby allowing the user to position the base plate 110 in a range of angles relative to the coupler 140 before tightening down the connecting fasteners.

The offset arm 351 may have a length in a range of about three inches to about 15 inches (e.g., about 4 inches to about 12 inches, about 5 inches to about 10 inches, or any value or range of values therein). The offset arm 352 may connect the first and second attachment points. The fastening holes 350 may be positioned relative to the coupler at various angles, allowing the adjustable bracket 348 to be positioned relative to the coupler such that the offset arm may be positioned at incremental angles (e.g., in increments of about 45°) relative to the longitudinal axis of the boat, e.g., at about 0°, about 45°, about 90°, about 135°, about 180°, about 225°, about 270°, and at about 315°. The offset arm 351 may allow more positioning options for the base plate 110 to accommodate different boat tower designs while avoiding contact or damage to the interior of the boat when the boat tower is collapsed. The offset arm 351 may also allow the base plate 110 position to be adjusted to accommodate other structures mounted on the boat tower, such as speakers.

The plurality of curved slots 349 at the second attachment point may be operable to receive connecting fasteners (e.g., bolt and nut, or other device) from the base plate 110. The curved, arch-like slots allow the base plate 110 to be rotated relative to the second attachment point, thereby allowing the user to position the base plate 110 in a range of angles relative to the second attachment point before tightening down the connecting fasteners. As shown in FIG. 6, this feature may allow the base plate 110 to be positioned such that it positions a board attached thereto in alignment with the longitudinal axis of the boat. For example, and without limitation, the adjustable bracket 348 may be connected to the coupler 140 suspended from tower crossbar 600 such that the offset arm 351 is positioned at 45° relative to the longitudinal axis of the boat, the base plate 110 may be positioned at 135° relative to the offset arm 351 such that the length of a board attached to the base plate 110 will be parallel to the longitudinal axis of the boat. This adjustability of the attachment angle of the base plate 110 to the second attachment point allows the user to avoid the drag that may result from an oblique or perpendicular orientation of the board.

Figure 7:
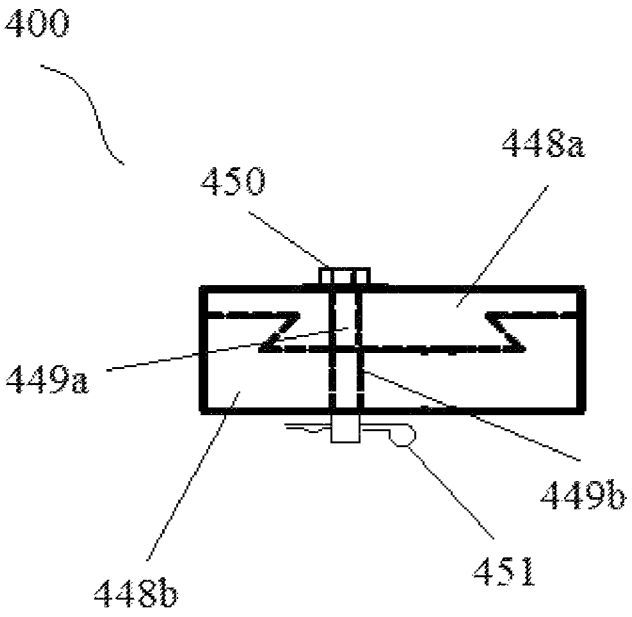
FIG. 7 shows a watersports board rack according to an embodiment of the present invention.
Figure 7:
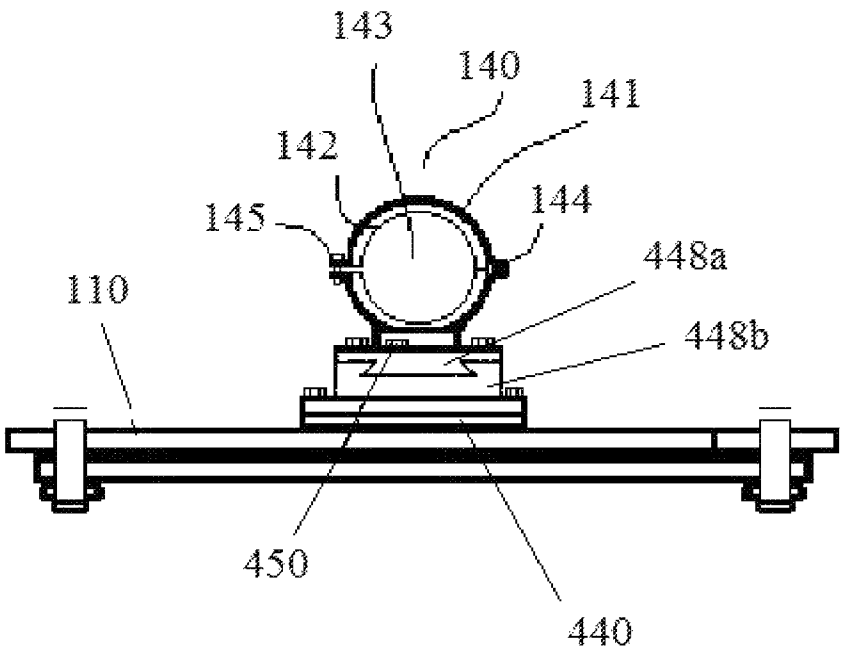

As shown in FIG. 7, the rack system may include a quick release mechanism 400 for quickly releasing the base plate 110 from the coupler 140. For example, the quick release mechanism 400 may include a male connector 448*a* and a female connector 448*b*, where the male connector 448*a* includes a protrusion having a first shape (e.g., a trapezoidal prism) that can be inserted or slotted into a receiver having a complementary shape in the female connector 448*b* (it is to be understood that the position of the male and female connectors may be reversed, such that the female connector is attached to the coupler 140 and the male coupler is attached to the base plate 110 or adjustment bracket 440). The quick release mechanism may also include a locking bolt, latch, pin, or other securing member 450 that secures the male connector 448*a* to the female connector 448*b* once the protrusion is fully inserted into the receiver. The male connector 448*a* and the female connector 448*b* may have securing member holes 449*a* and 449*b*, respectively, as shown in the cross-sectional view of quick release 400 provided in FIG. 7. The securing member 450 may be inserted through securing member holes 449*a* and 449*b* when the protrusion is fully inserted in the receiver, placing securing member holes 449*a* and 449*b* in alignment with one another. The securing member 450 secures the male connector 448*a* and female connector 448*b* in their mutually engaged position. The securing member 450 may include an R-clip or cotter pin 451 that prevents the securing member 450 from dislodging from the securing member holes 449*a* and 449*b*.

The female connector 448*b* may be operable to be connected to an adjustment bracket 440, which in turn may be connected to the base plate 110. The position of the adjustable bracket 440 may be adjustable relative to the female connector 448*b* to allow the base plate 110 to be oriented at varying angles. For example, and without limitation, the female connector 448*b* may have a receiver plate for attachment to the adjustable bracket 440, and the adjustable bracket 440 may have a plurality of curved slots arranged in arches equidistantly positioned relative to the center point thereof. These slots may be operable to receive connecting fasteners (e.g., bolt and nut, or other device) from the receiver plate of the female connector 448*b*. The curved, arch-like slots allow the adjustable bracket 440 to be rotated relative to the receiver plate, thereby allowing the user to position the adjustment bracket 440 such that the base plate 110 can be positioned in a range of angles relative to the coupler 140 before tightening down the connecting fasteners.

In some embodiments, the quick release mechanism 400 may be paired with the adjustable bracket having the offset arm. In such examples, the second attachment point of the adjustable bracket may be a plate-like structure that can be adjustably connected to the receiver plate of the female connector 448*b*. The second attachment point may have a plurality of curved slots arranged in arches equidistantly positioned relative to the center point thereof. These slots may be operable to receive connecting fasteners (e.g., bolt and nut, or other device) from the receiver plate. The curved, arch-like slots allow the receiver plate to be rotated relative to the second attachment point, thereby allowing the user to position the receiver plate in a range of angles relative to the second attachment point before tightening down the connecting fasteners.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A rack system for securing a watersports board operable to connected to an overhead ski boat tower by a single coupler, the system comprising:
   a. a substantially planar base plate;
   b. at least one securing device for securing said watersports board against said substantially planar base plate, wherein said substantially planar base plate is operable to interface with a deck of said watersports board such that said deck is substantially parallel to said substantially planar base plate;
   c. said single coupler for providing a mechanical connection point for attachment of said base plate to a frame member of said overhead ski boat tower, wherein said coupler is the only mechanical connection of the rack system to said overhead ski boat tower, wherein the at least one securing device is operable to secure said watersports board to an underside of the planar base plate when the base plate is suspended below the overhead ski boat tower in a horizontal attitude while a boat in which the ski boat tower is installed is in motion.

2. The system of claim 1, wherein said base plate comprises a rigid material.

3. The system of claim 1, wherein said base plate comprises at least one attachment element for attaching said securing device to said base plate.

4. The system of claim 3, further comprising a quick release mechanism between said base plate and said coupler, said quick release mechanism having a nesting arrangement between a first connector in mechanical connection with the coupler and a second connector, wherein, the first and second connectors having complementary interlocking structures that are operable to be coupled in a nested arrangement.

5. The system of claim 4, wherein said quick release mechanism includes a securing mechanism that holds said first and second connectors in position when they are in the nested arrangement.

6. The system of claim 1, wherein a width of said base plate is about equal to the width of said watersports board.

7. The system of claim 1, further comprising an adjustable bracket between said base plate and said coupler, said adjustable bracket being operable to allow the base plate to be positioned at various angles relative to said coupler, and said coupler is operable to position said base plate at various angles relative to said coupler in a first plane.

8. The system of claim 7, wherein said adjustable bracket having an offset arm, a first attachment point, and a second attachment point, wherein said offset arm provides a radius between said first attachment point and said second attachment point, such that said base plate is offset from said coupler when said first attachment point is mechanically connected to said coupler and said second attachment point is mechanically connected to said base plate, wherein said radius of said offset arm may be positioned at various angles relative to said coupler in said first plane.

9. The system of claim 7, further comprising a quick release mechanism between said adjustable bracket and said coupler, said quick release mechanism operable to allow the entire base plate to be removed from the coupler and having a nesting arrangement between a first connector in mechanical connection with the coupler and a second connector, wherein, the first and second connectors having complementary interlocking structures that are operable to be coupled in a nested arrangement.

10. The system of claim 1, further comprising a pad for providing cushion to said watersports board, wherein said pad comprises a thickness in a range from approximately 2 mm to approximately 10 mm.

11. A rack system for securing a watersports board in a boat, the system comprising:
   a. a base plate;
   b. at least one securing device for securing said watersports board to said base plate, wherein a deck of said watersports board interfaces with said base plate such that the deck is substantially parallel to said base plate;
   c. a coupler for providing the only mechanical connection point for said base plate to a frame member of an overhead ski boat tower in the boat; and
   d. an adjustable bracket between said base plate and said coupler, said adjustable bracket being operable to allow the base plate to be positioned at various angles relative to said coupler, wherein the at least one securing device is operable to secure said watersports board to an underside of the planar base plate when the base plate is suspended below the overhead ski boat tower in a horizontal attitude while the boat is in motion.

12. The system of claim 11, wherein said adjustable bracket having an offset arm, a first attachment point, and a second attachment point, wherein said offset arm provides a radius between said first attachment point and said second attachment point, such that said base plate is offset from said coupler when said first attachment point is mechanically connected to said coupler and said second attachment point is mechanically connected to said base plate, wherein a radius of said offset arm may be positioned at various angles relative to said coupler in a first plane.

13. The system of claim 11, further comprising a quick release mechanism between said adjustable bracket and said coupler, said quick release mechanism operable to allow the entire base plate to be removed from the coupler and having a nesting arrangement between a first connector in mechanical connection with the coupler and a second connector, wherein, the first and second connectors having complementary interlocking structures that are operable to be coupled in a nested arrangement.

14. The system of claim 12, wherein said quick release mechanism includes a securing mechanism that holds said first and second connectors in position when they are in the nested arrangement.

15. The system of claim 11, wherein said securing device comprises a plurality of straps, each strap having a strap pad and a tightening element.

16. A rack system for securing a watersports board to a support member of a boat operable to be connected to an overhead ski boat tower by a single coupler, the system comprising:

a. a low-profile base plate for attachment to said overhead ski boat tower, said low-profile base plate operable to be installed on a support member of said tower such that the base plate is less than about 5 inches from said support member;

b. at least one securing device for securing said watersports board against said base plate such that a deck of said watersports board interfaces with and is substantially parallel to said base plate;

c. an adjustable bracket attached to said base plate, said adjustable bracket being operable to allow the base plate to be positioned to hold said water sports board at various angles relative to said tower; and d. said single coupler for providing the only mechanical connection point of said rack system to a frame member of said overhead ski boat tower, wherein the at least one securing device is operable to secure said watersports board to an underside of the planar base plate when the base plate is suspended below the overhead ski boat tower in a horizontal attitude while a boat in which the ski boat tower is installed is in motion.

17. The system of claim 16, wherein said adjustable bracket having an offset arm, a first attachment point, and a second attachment point, wherein said offset arm provides a radius between said first attachment point and said second attachment point, such that said base plate is offset from a coupler attached to said tower when said first attachment point is mechanically connected to said coupler and said second attachment point is mechanically connected to said base plate, wherein said radius of said offset arm may be positioned at various angles relative to said coupler.

18. The system of claim 16, further comprising a quick release mechanism between said adjustable bracket and said coupler, said quick release mechanism being operable to allow the entire base plate to be removed from the coupler and having a nesting arrangement between a first connector in mechanical connection with the coupler and a second connector, wherein the first and second connectors having complementary interlocking structures that are operable to be coupled in a nested arrangement.

19. The system of claim 1, wherein said deck interfaces only with said substantially planar base plate.

20. The method of claim 1, wherein said coupler is operable to position said base plate at multiple angles relative to the ski boat tower.

* * * * *